US009614353B2

(12) United States Patent
Kawashima

(10) Patent No.: US 9,614,353 B2
(45) Date of Patent: Apr. 4, 2017

(54) SPARK PLUG

(71) Applicant: NGK Spark Plug Co., LTD., Nagoya (JP)

(72) Inventor: Yusuke Kawashima, Kakamigahara (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/755,361

(22) Filed: Jun. 30, 2015

(65) Prior Publication Data

US 2015/0380907 A1 Dec. 31, 2015

(30) Foreign Application Priority Data

Jun. 30, 2014 (JP) ..... 2014-134331

(51) Int. Cl.
*H01T 13/20* (2006.01)
*H01T 13/32* (2006.01)
*H01T 13/39* (2006.01)

(52) U.S. Cl.
CPC ..... *H01T 13/32* (2013.01); *H01T 13/39* (2013.01)

(58) Field of Classification Search
CPC ..... H01T 13/32; H01T 13/39; H01T 13/20
USPC ..... 313/141
See application file for complete search history.

(56) References Cited

U.S. PATENT DOCUMENTS 8,212,463 B2 * 7/2012 Sakayanagi ..... H01T 13/20 313/118
2002/0121849 A1 9/2002 Kanao et al.
2005/0057133 A1 * 3/2005 Hori ..... H01T 13/39 313/141
2007/0103046 A1 * 5/2007 Tinwell ..... H01T 13/20 313/143
2010/0264801 A1 * 10/2010 Tanaka ..... C22C 5/04 313/141
2012/0062099 A1 * 3/2012 Miyashita ..... B23K 26/28 313/144
2014/0203701 A1 7/2014 Kretschmar et al.

FOREIGN PATENT DOCUMENTS

DE 102011077279 A 12/2012
JP 2002-313524 A 10/2002

* cited by examiner

*Primary Examiner* — Donald Raleigh
(74) *Attorney, Agent, or Firm* — Leason Ellis LLP

(57) ABSTRACT

A spark plug comprises a ground electrode including a chip whose one end has a cylinder shape having a diameter A from 0.8 to 1.2 mm and whose main component is a noble metal, and an electrode base material. In the ground electrode, a portion of the other end of the chip is joined to the electrode base material through a fused portion. The spark plug also comprises a chip-and-base-material interface in which the chip and the electrode base material contact each other and which is surrounded by the fused portion. In a cross section passing through a center axis, a distance between an end point Pa7 located on the chip-and-base-material interface and an end point Pa5 located on an interface between the chip and the fused portion is equal to or greater than 0.7 times the diameter A.

13 Claims, 12 Drawing Sheets

| CHIP DIAMETER A | ϕ | | | | | |
|---|---|---|---|---|---|---|
| | 0.7 | 0.8 | 1.0 | 1.2 | 1.4 | 1.5 |
| RATING | ○ | ○ | — | ○ | × | × |

| CHIP DIAMETER A | ϕ | | | | | |
|---|---|---|---|---|---|---|
| | 0.7 | 0.8 | 1.0 | 1.2 | 1.4 | 1.5 |
| RATING | × | ○ | — | ○ | ○ | ○ |

SPARK PLUG

This application claims the benefit of Japanese Patent Applications No. 2014-134331, filed Jun. 30, 2014, which is incorporated by reference in its entities herein.

FIELD OF THE INVENTION

The present invention relates to a spark plug including a noble metal chip that is provided on an electrode.

BACKGROUND OF THE INVENTION

Hitherto, among spark plugs, there are spark plugs including a noble metal chip that is provided on a center electrode and a noble metal chip that is provided on a ground electrode (See German Patent Application Laid-Open No. 102011077279). When, in such spark plugs, spark discharge is repeatedly performed between the electrodes provided with the noble metal chips, a discharge surface of the noble metal chip of the center electrode and a discharge surface of the noble metal chip of the ground electrode are worn. This causes a gap formed between the center electrode and the ground electrode to be enlarged, as a result of which it is no longer possible to stably generate sparks.

Accordingly, a technology for suppressing wearing of a noble metal chip of a ground electrode as a result of enlarging a discharge surface by increasing the diameter of the noble metal chip of the ground electrode exists (See Japanese Patent Application Laid-Open No. 2002-313524).

Technical Problem

A noble metal chip of an electrode is disposed on an electrode base material. After previously tentatively fixing the noble metal chip to the electrode base material by resistance welding, the vicinity of a bottom portion of the noble metal chip is subjected to laser beam welding to join the noble metal chip to the electrode base material. More specifically, the bottom portion of the noble metal chip is fused by laser that is applied to an outer periphery thereof, and forms, along with a material of the electrode base material that is similarly fused by the laser, a fused portion. The electrode base material contains, for example, nickel as a main component. The noble metal chip is formed of, for example, a platinum alloy or an iridium alloy.

However, when, as in the above-described related arts, the diameter of the noble metal chip is increased, the vicinity of the outer periphery of the bottom portion of the noble metal chip is fused, whereas the vicinity of the center of the bottom portion of the noble metal chip is not fused by the laser. As a result, the vicinity of the center of the bottom portion of the noble metal chip remains tentatively fixed to the electrode base material by the resistance welding.

When, in such a state, the spark plug is repeatedly exposed to combustion in a combustion chamber of an engine, the difference between the thermal expansion coefficient of the material of the noble metal chip and the thermal expansion coefficient of the material of the electrode base material causes a crack to occur between the electrode base material and the bottom portion of the tentatively fixed noble metal chip. Strain caused by the difference between the thermal expansion coefficients becomes a maximum at an outer periphery of an interface between the electrode base material and the bottom portion of the tentatively fixed noble metal chip. As a result, a crack occurs in an interface between the noble metal chip and the fused portion that contacts the outer periphery of the interface between the electrode base material and the bottom portion of the tentatively fixed noble metal chip. Repeated combustion in the combustion chamber of the engine causes the crack to grow along the interface between the noble metal chip and the fused portion. When the crack reaches an outer peripheral surface of the fused portion and an outer peripheral surface of the noble metal chip, the probability with which the noble metal chip comes off from the electrode becomes high. Consequently, when, as in the above-described related arts, the diameter of the noble metal chip is increased, the coming off of the noble metal chip from the electrode caused by the crack makes it difficult for the spark plug to have a long life.

SUMMARY OF THE INVENTION

Solution to Problem

The present invention has been carried out to solve at least some of the aforementioned problems, and can be realized as the following forms.

(1) According to a form of the present invention, there is provided a spark plug. The spark plug comprises a ground electrode including a chip whose one end has a shape of a cylinder having a diameter from 0.8 to 1.2 mm and whose main component is a noble metal, and an electrode base material to which a portion of the other end of the chip is joined through a fused portion where the chip and the electrode base material are fused. The spark plug also comprises a chip-and-base-material interface in which a surface of the other end of the chip and the electrode base material contact each other and which is surrounded by the fused portion. In a cross section passing through a center axis of the cylinder, a distance between an end point that is located one side of the chip-and-base-material interface with respect to the center axis and an end point that is located on an interface between the chip and the fused portion and is exposed to the outside is equal to or greater than 0.7 times the diameter.

According to this form, compared to a case in which the distance between an end point on the chip-and-base-material interface and an end point on the interface between the chip and the fused portion is less than 0.7 times the diameter of the chip, a crack that has occurred from the end point on the chip-and-base-material interface grows along the interface between the chip and the fused portion, as a result of which it is possible to increase the distance to where the crack reaches an outer portion. Therefore, the life of the spark plug including a chip whose end portion has a diameter of from 0.8 to 1.2 mm can be increased by providing time up to when the chip comes off due to the crack while reducing wear of the chip caused by a spark.

(2) In the spark plug of the above-described form, in the cross section, a distance between two end points on the chip-and-base-material interface may be equal to or less than 0.35 mm.

In this form, compared to a case in which the distance between the end points on two ends of the chip-and-base-material interface is greater than 0.35 mm, it is possible to reduce strain caused by a difference between the thermal expansions at the two ends of the chip-base material interface. As a result, compared to the aforementioned case, it is possible to reduce the occurrence of cracks at the end points on the chip-and-base-material interface.

(3) In the spark plugs of the above-described forms, in the cross section, a distance in a direction orthogonal to the center axis between an end point that is located on an interface between the electrode base material and the fused portion and is exposed to the outside and an outer surface of the cylindrical portion of the chip may be equal to or less than 0.35 mm.

In this form, compared to a case in which the distance between the end point on the interface between the electrode base material and the fused portion and the outer surface of the end portion of the chip is greater than 0.35 mm, the fused portion does not extend to a portion of the electrode base material that is far away from the chip. That is, it is possible to reduce the amount of electrode base material that is fused when the fused portion is formed during the welding. As a result, it is possible for the composition of the material of the fused portion to be close to that of the material of the chip. Therefore, it is possible to reduce the difference between the thermal expansion coefficient of the material of the fused portion and the thermal expansion coefficient of the material of the chip. Consequently, it is possible to reduce the occurrence and growth of cracks caused by a difference between the thermal expansion coefficients at the interface between the fused portion and the chip.

(4) In the spark plug according to the above-described forms, the noble metal may be selected from the group consisting of Pt, Rh, Ir, and Ru.

The present invention may be realized in various forms other than a spark plug. For example, the forms in which the present invention may be realized include a ground electrode, a method for welding a ground electrode, a method for producing a ground electrode, and a method for producing a spark plug.

BRIEF DESCRIPTION OF DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. Embodiments

A1. Overall Structure of Spark Plug

Figure 1:
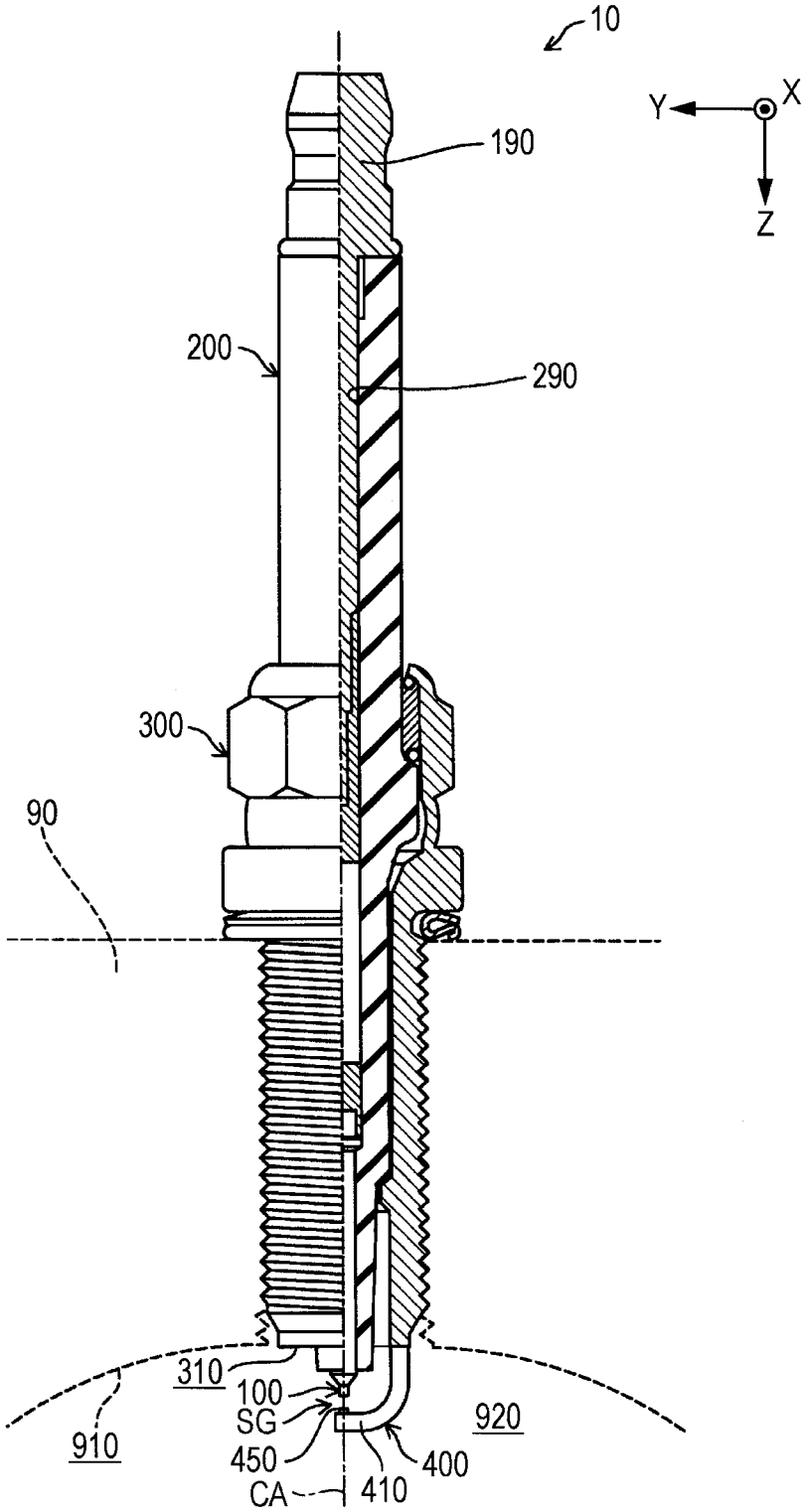
FIG. 1 is a partial sectional explanatory view of a spark plug 10.

FIG. 1 is a partial sectional explanatory view of a spark plug 10. FIG. 1 illustrates, with an axis CA corresponding to an axis of the spark plug 10 serving as a boundary, an external shape of the spark plug 10 on the left of the axis CA in the plane of FIG. 1 and a cross sectional shape of the spark plug 10 on the right of the axis CA in the plane of FIG. 1. In the description of the present embodiment, a lower side of the spark plug 10 in the plane of FIG. 1 is called "front end side", and an upper side of the spark plug 10 in the plane of FIG. 1 is called "rear end side".

The spark plug 10 includes a center electrode 100, an insulator 200, a metal shell 300, and a ground electrode 400. In the embodiment, the axis CA of the spark plug 10 is also an axis of each of the center electrode 100, the insulator 200, and the metal shell 300.

The spark plug 10 has a gap SG at the front end side. The gap SG is formed between the center electrode 100 and the ground electrode 400. The gap SG of the spark plug 10 is also called a "spark gap". The spark plug 10 is formed so as to be mountable on an internal combustion engine 90 with the front end side where the gap SG is formed protruding from an inner wall 910 of a combustion chamber 920. When, with the spark plug 10 mounted on the internal combustion engine 90, a high voltage (such as 10000 to 50000 volts) is applied to the center electrode 100, a spark discharge occurs in the gap SG. The spark discharge that has occurred in the gap SG causes an air-fuel mixture to be ignited in the combustion chamber 920.

In FIG. 1, an X axis, a Y axis, and a Z axis that are orthogonal to each other are shown. The X axis, the Y axis, and the Z axis shown in FIG. 1 correspond to an X axis, a Y axis, and a Z axis in the other figures described below.

Of the X axis, the Y axis, and the Z axis shown in FIG. 1, the X axis is an axis that is orthogonal to the Y axis and the Z axis. Of X axis directions along the X axis, a +X axis direction is a direction from a far side to a near side in the plane of FIG. 1, and a −X axis direction is a direction that is opposite to the +X axis direction.

Of the X axis, the Y axis, and the Z axis shown in FIG. 1, the Y axis is an axis that is orthogonal to the X axis and the Z axis. Of Y axis directions along the Y axis, a +Y axis direction is a direction from right to left in the plane of FIG. 1, and a −Y axis direction is a direction that is opposite to the +Y axis direction.

Of the X axis, the Y axis, and the Z axis shown in FIG. 1, the Z axis is an axis that extends along the axis CA. Of Z axis directions along the Z axis (axial directions), a +Z axis direction is a direction from the rear end side to the front end side of the spark plug 10, and a −Z axis direction is a direction that is opposite to the +Z axis direction.

The center electrode 100 of the spark plug 10 is a conductive electrode. The center electrode 100 has a bar shape that extends along the axis CA as center. In the embodiment, the center electrode 100 is formed of a nickel alloy whose main component is nickel (Ni) (for example, Inconel 600 is a registered trademark). In the description of the specification, the term "main component" refers to a component that is contained by the largest amount when each component contained in a composition is compared by using % by mass. An outer surface of the center electrode 100 is electrically insulated from the outside by the insulator 200. The front end side of the center electrode 100 protrudes from the front end side of the insulator 200. The rear end side of the center electrode 100 is electrically connected to a structure that is positioned at the rear end side of the insulator 200. In the embodiment, the rear end side of the center electrode 100 is electrically connected to the structure that is positioned at the rear end side of the insulator 200 through a terminal metal shell 190.

The insulator 200 of the spark plug 10 is an electrically insulating member. The insulator 200 has a cylindrical shape extending along the axis CA as center. In the embodiment, the insulator 200 is formed by sintering an insulating ceramic material (such as alumina). The insulator 200 has a shaft hole 290 that is a through hole extending along the axis CA as center. With the center electrode 100 protruding from the front end side of the insulator 200, the center electrode 100 is held in the shaft hole 290 of the insulator 200 along the axis CA.

The metal shell 300 of the spark plug 10 is a conductive metallic body. The metal shell 300 has a cylindrical shape extending along the axis CA as center. In the embodiment, the metal shell 300 is a member formed of a cylindrical low-carbon steel subjected to nickel plating. In other embodiments, the metal shell 300 may be a member subjected to zinc plating, or a member that is not plated (uncovered). With the metal shell 300 being electrically insulated from the center electrode 100, the metal shell 300 is fixed to an outer surface of the insulator 200 by crimping. An end face 310 is formed at the front end side of the metal shell 300. From the center of the end face 310, the insulator 200, along with the center electrode 100, protrudes in the +Z axis direction. The ground electrode 400 is joined to the end face 310.

The ground electrode 400 of the spark plug 10 is a conductive electrode. The ground electrode 400 includes an electrode base material 410 and an electrode chip 450. The electrode base material 410 has a shape that is bent towards the axis CA after extending in the +Z axis direction from the end face 310 of the metal shell 300. The rear end side of the electrode base material 410 is joined to the metal shell 300. The electrode chip 450 is joined to the front end side of the electrode base material 410. The gap SG is formed between the electrode chip 450 and the center electrode 100.

In the embodiment, as with the center electrode 100, the material of the electrode base material 410 is a nickel alloy whose main component is nickel (Ni). In the embodiment, the material of the electrode chip 450 is an alloy containing platinum (Pt) as a main component and 20% rhodium (Rh) by mass. In the other embodiments, the material of the electrode chip 450 may be any material as long as it is one whose durability is higher than that of the electrode base material 410. The material of the electrode chip 450 may be a pure noble metal (such as platinum (Pt), iridium (Ir), ruthenium (Ru), or rhodium (Rh)), or may be other alloys containing such noble metals as main components (such as an alloy containing any of these noble metals as a main component and Ni).

A2. Structure of Vicinity of Electrode Chip of Ground Electrode

Figure 2:
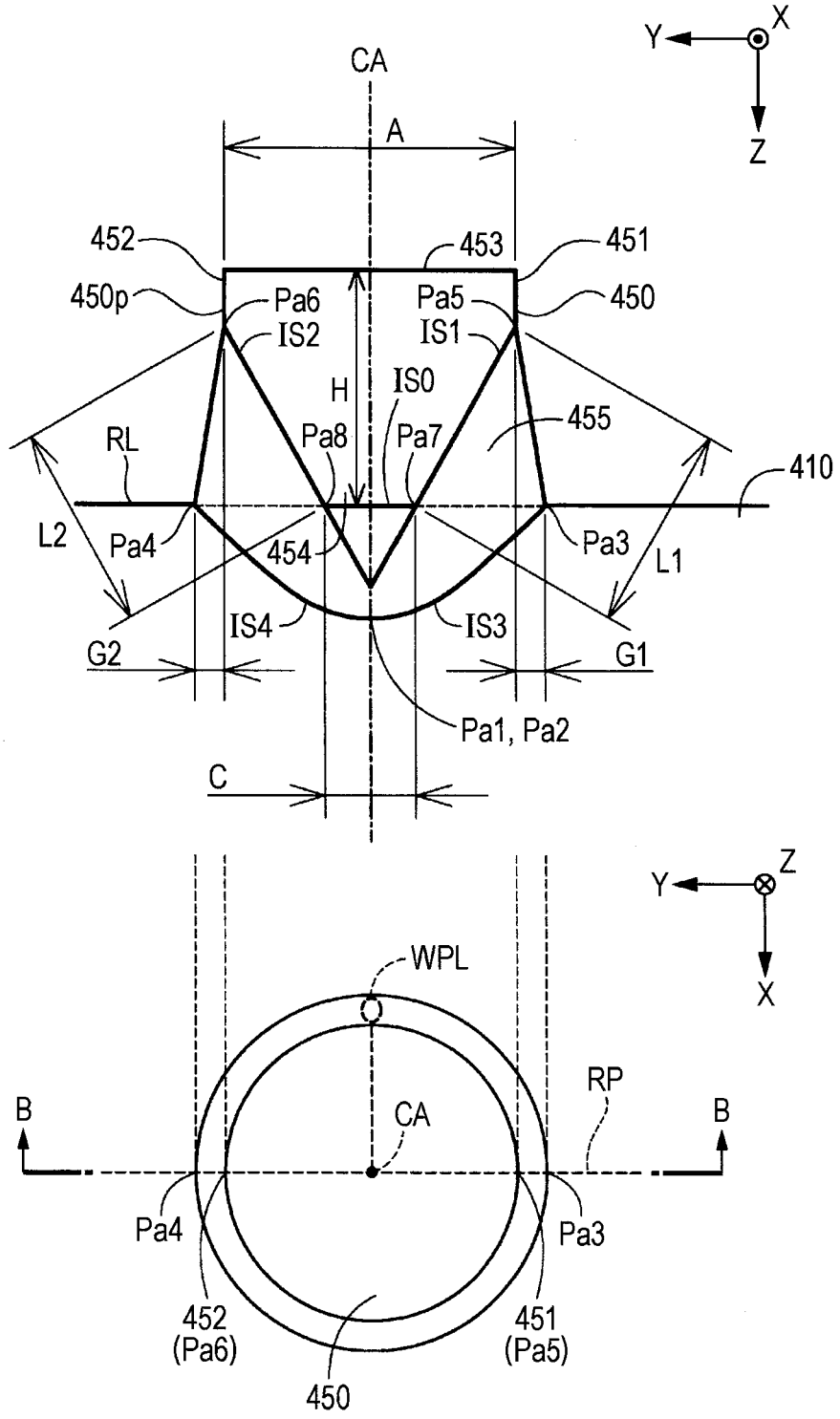
FIG. 2 is a cross-sectional view and a plan view of a structure of the vicinity of an electrode chip 450 provided on a ground electrode 400 of the spark plug 10.

FIG. 2 is a cross-sectional view and a plan view of a structure of the vicinity of the electrode chip 450 provided on the ground electrode 400 of the spark plug 10. The electrode chip 450 has a substantially cylindrical shape. The electrode chip 450 is disposed at the ground electrode 400 such that the axis CA of the spark plug 10 and a center axis of a cylinder of the electrode chip 450 coincide with each other.

The electrode chip 450 is provided at the ground electrode 400 by the following operations. First, the substantially cylindrical electrode chip 450 is disposed on a predetermined position on the electrode base material 410. Then, the electrode chip 450 and the electrode base material 410 are welded to each other by resistance welding. As a result, the electrode chip 450 and the electrode base material 410 are tentatively fixed to each other. Thereafter, a portion where the electrode chip 450 and the electrode base material 410 are in contact with each other is irradiated with a laser beam from the vicinity of the electrode chip 450, and the electrode chip 450 and the electrode base material 410 are welded to each other by laser beam welding. For the laser beam welding, any type of laser, such as gas laser, solid laser, or semiconductor laser, may be used.

When performing the laser beam welding, the laser beam is applied towards the axis CA of the electrode chip 450 from an outer periphery of the electrode chip 450 and towards the electrode base material 410 from the electrode chip 450. The laser beam is applied to 15 to 25 portions that are situated at substantially equal angles around the axis CA so as to be directed towards the electrode chip 450 and the electrode base material 410 from the vicinity of the electrode chip 450.

As a result, a portion of the electrode chip 450 and a portion of the electrode base material 410 are fused and melted together, to form a fused portion 455. When the fused portion 455 is cooled and solidified, of portions of the electrode chip 450, in an axial direction, the electrode base material 410 and an end portion 454 at a side opposite to an end face 453 at an exposed side are joined to each other through the fused portion 455. Of portions of the electrode chip 450 that are not fused, an end portion 450*p* at a side opposite to the electrode base material 410 (end-surface-453 side) has a cylindrical shape. The upper sectional illustration in FIG. 2 is a cross-sectional view at a cross section RP along line B-B that extends on and beyond the axis CA and that includes a direction in which the ground electrode 400 extends towards the axis CA (see the lower illustration in FIG. 2).

In the present specification, when the state after the fused portion 455 has been formed is to be described, of portions of the electrode chip 450 provided first along with the electrode base material 410, portions that are not fused are called the "electrode chip 450". When the state after the fused portion 455 has been formed is to be described, of portions of the electrode base material 410 provided first along with the electrode chip 450, portions that are not fused are called the "electrode base material 410".

As a result of the laser beam welding, the formed welded portion 455 has a shape such as that described below in the cross section that extends on and beyond the axis CA. Symbols that represent respective portions of the electrode chip 450 are defined as follows:

451: Outer surface of the cylindrical portion 450*p* of the electrode chip 450 on one side (right side in FIG. 2) of the axis CA

452: Outer surface of the cylindrical portion 450*p* of the electrode chip 450 on the other side (left side in FIG. 2) of the axis CA

453: End face of the electrode chip 450 on a side opposite to the side where the electrode base material 410 is positioned in an axial direction Symbols that represent respective portions of the fused portion 455 are defined as follows.

Pa1: Point which is situated on a portion of the fused portion 455 on one side (right side in FIG. 2) of the axis CA and which is farthest from the end face 453 in an axial direction Pa2: Point which is situated on a portion of the fused portion 455 on the other side (left side in FIG. 2) of the axis CA and which is farthest from the end face 453 in an axial direction Pa3: End point which is situated on an interface IS3 between the electrode base material 410 and the fused portion 455 on one side of the axis CA and which is exposed to the outside Pa4: End point which is situated on an interface IS4 between the electrode base material 410 and the fused portion 455 on the other side of the axis CA and which is exposed to the outside Pa5: End point which is situated on a portion of the fused portion 455 on one side of the axis CA, which is situated on an interface IS1 between the electrode chip 450 and the fused portion 455, and which is exposed to the outside Pa6: End point which is situated on a portion of the fused portion 455 on the other side of the axis CA, which is situated on an interface IS2 between the electrode chip 450 and the fused portion 455, and which is exposed to the outside Pa7: End point which is situated on an interface IS0 between the electrode chip 450 and the electrode base material 410 and which is situated on one side of the axis CA Pa8: End point which is situated on the interface IS0 between the electrode chip 450 and the electrode base material 410 and which is situated on the other side of the axis CA RL: Reference line which is a straight line passing through the point Pa3 and the point Pa4

Symbols that represent the dimensions of the electrode chip 450 and the fused portion 455 are defined as follows.

A: Width of the electrode chip 450 at an end situated on a side that is opposite to the side where the electrode base material 410 is positioned in an axial direction (the diameter of the cylinder of the cylindrical portion 450*p*)

C: Distance between the end point Pa7 and the end point Pa8 on the interface IS0

L1: Distance between the end point Pa7 on the interface IS0 and the end point Pa5 on the interface IS1 on one side of the axis CA L2: Distance between the end point Pa8 on the interface IS0 and the end point Pa6 on the interface IS2 on other side of the axis CA G1: Distance between the outer surface 451 of the cylindrical portion 450*p* of the electrode chip 450 and the end point Pa3 in a direction perpendicular to the axis G2: Distance between the outer surface 452 of the cylindrical portion 450*p* of the electrode chip 450 and the end point Pa4 in a direction perpendicular to the axis H: Distance from an intersection point of the axis CA and the reference line RL to an intersection point of the axis CA and the end face 453

L1 can be generally understood as the length of the interface IS1. L2 can be generally understood as the length of the interface IS2. H can be generally understood as the height of the electrode chip 450.

In the embodiment, in a cross section that extends on and beyond the axis CA, the fused portion 455 has a shape that satisfies the following conditions:

$$L1 \geq 0.7 \times A \quad (1) \text{ and}$$

$$L2 \geq 0.7 \times A \quad (2)$$

In the embodiment that satisfies the aforementioned Formulas (1) and (2), compared to a form in which the aforementioned Formulas (1) and (2) are not satisfied, the distance L1 between the end point Pa7 on the interface IS0 and the end point Pa5 on the interface IS1 and the distance L2 between the end point Pa8 on the interface IS0 and the end point Pa6 on the interface IS2 are long. Such a form provides the following advantages. That is, compared to the form in which the aforementioned Formulas (1) and (2) are not satisfied, it is possible to increase the distance up to where cracks that grow along the interface IS1 and the interface IS2 between the electrode chip 450 and the fused portion 455 from the interface IS0 between the electrode chip 450 and the electrode base material 410 reach ends at outer portions of the interfaces IS1 and IS2 (the end points Pa5 and Pa6 in FIG. 2). Therefore, it is possible to increase the period up to when the electrode chip 450 comes off from the fused portion 455 due to cracks that occur in the interfaces IS1 and IS2 between the fused portion 455 and the electrode chip 450 as a result of a difference between the thermal expansion coefficient (linear expansion coefficient) of the fused portion 455 and the thermal expansion coefficient (linear expansion coefficient) of the electrode chip 450 when the spark plug 10 is mounted on an engine, the engine is operated, and a combustion cycle is executed. Even if the spark plug 10 is replaced in a sufficiently short period that has been previously determined, compared to the form in which the aforementioned Formulas (1) and (2) are not satisfied, it is possible to reduce the probability with which the electrode chip 450 comes off from the fused portion 455 before the spark plug 10 is replaced.

It is desirable that Formulas (1) and (2) be satisfied in any cross section that extends on and beyond the axis CA. However, ideally, the chip of the ground electrode of the spark plug is rotationally symmetrically provided. Therefore, if, in a predetermined cross section, the aforementioned Formulas (1) and (2) are satisfied, it may be thought that the aforementioned advantages according to the embodiment are provided. Therefore, whether or not the aforementioned Formulas (1) and (2) are satisfied is determined in the plane RP (see the lower illustration in FIG. 2) that extends on and beyond the axis of the electrode chip 450 and in which the ground electrode 400 extends. When the cross sectional shape of the fused portion 455 is hereunder to be determined, the cross section RP is used as a reference.

In the embodiment, the fused portion 455 has a shape that also satisfies the following condition in the cross section RP that extends on and beyond the axis CA:

$$C \leq 0.35 \text{ mm} \quad (3)$$

Satisfying the aforementioned Formula (3) means that, the interface IS0 is smaller than that in a form in which the aforementioned Formula (3) is not satisfied. Such a form provides the following advantages.

The thermal expansion coefficient of a material (such as platinum (Pt), iridium (Ir), ruthenium (Ru), and rhodium (Rh)) of the electrode chip 450 is less than the thermal expansion coefficient of a nickel alloy, which is a material of the electrode base material 410. Therefore, when, at the interface IS0 where they contact each other, the temperature is increased, that is, the temperature is made to differ from the temperature when they are joined, strain occurs. On the other hand, the other interfaces IS1 to IS4 are each formed of a mixture of the material of the electrode base material 410 and the material of the electrode chip 450, and are interfaces where the fused portion 455 having a thermal expansion coefficient that is intermediate between those of the electrode base material 410 and the electrode chip 450 contacts the material of the electrode base material 410 or the material of the electrode chip 450. Therefore, strain occurring due to differences between thermal expansions is smaller in the other interfaces IS1 to IS4 than in the interface IS0. Consequently, since temperature changes repeatedly occur due to a heat cycle of the engine, cracks occur in the interface IS0 at an earlier stage than in the other interfaces IS1 to IS4.

Further, in the interface IS0, stress caused by the strain becomes largest at outer peripheral portions thereof, that is, at the end points Pa7 and Pa8 in the cross section in FIG. 2. By reducing the size of the interface IS0, it is possible to reduce the difference in size between the electrode chip 450 and the electrode base material 410 at the outer peripheral portions of the interface IS0 caused by thermal expansion. As a result, it is possible to reduce thermal stress exerted on the outer peripheral portions of the interface IS0. Consequently, it is possible to reduce the probability with which the electrode chip 450 comes off from the electrode base material 410 due to the occurrence of cracks from the outer peripheral portions of the interface IS0 and the growth of the cracks to the interfaces IS1 and IS2 between the fused portion 455 and the electrode chip 450.

In the embodiment, the fused portion 455 has a shape that further satisfies the following conditions in the cross section that extends on and beyond the axis CA:

$$G1 \geq 0.35 \text{ mm} \quad (4) \text{ and}$$

$$G2 \geq 0.35 \text{ mm} \quad (5)$$

In the spark plug including the fused portion 455 having a shape that satisfies Formulas (4) and (5), when the electrode chip 450 and the electrode base material 410 are welded to each other by laser beam welding, a portion of the electrode base material 410 that is disposed far away from the electrode chip 450 is not fused compared to a form in which the aforementioned Formulas (4) and (5) are not satisfied. Therefore, compared to the form in which the aforementioned Formulas (4) and (5) are not satisfied, the spark plug including the fused portion 455 having a shape that satisfies Formulas (4) and (5) allows the proportion of the material of the electrode chip 450 in the material of the fused portion 455 to be increased. As a result, it is possible for the thermal expansion coefficient of the fused portion 455 to be close to the value of the thermal expansion coefficient of the electrode chip 450. Consequently, it is possible to further reduce the probability with which cracks occur and grow along the interfaces IS1 and IS2 between the fused portion 455 and the electrode chip 450 when an engine is operated and a combustion cycle is executed.

Figure 3:
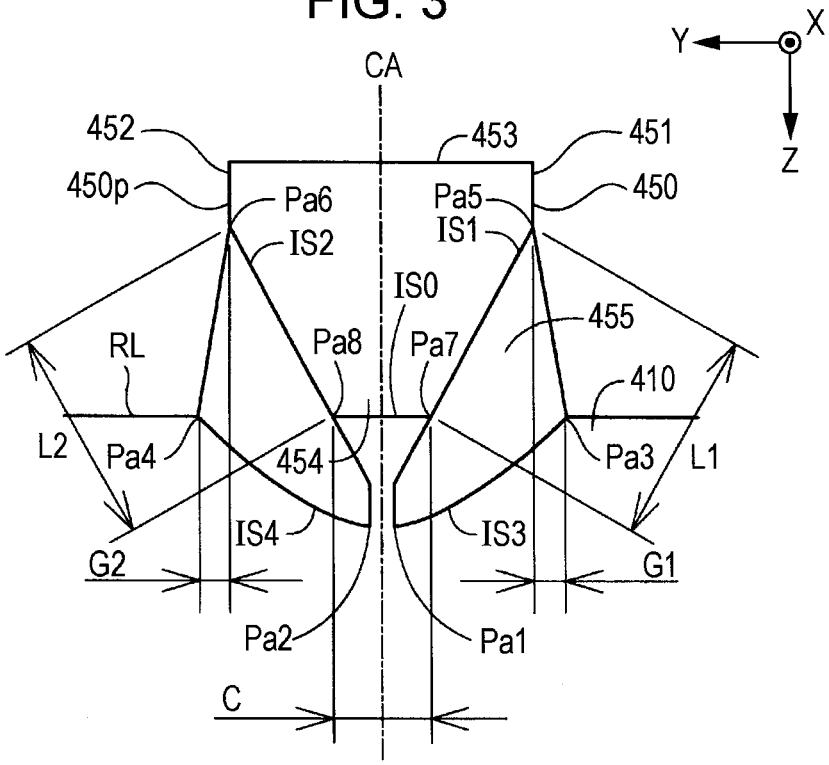
FIG. 3 is a cross-sectional view of another structure of the vicinity of the electrode chip 450 provided on the ground electrode 400 of the spark plug 10.

A3. Other Structures of the Vicinity of the Electrode Chip of the Ground Electrode FIG. 3 is a cross-sectional view of another structure of the vicinity of the electrode chip 450 provided on the ground electrode 400 of the spark plug 10. In the form shown in FIG. 2, the fused portion 455 extends from the outer surface 451 of the electrode 450, which is situated on one side of the axis CA, to the outer surface 452 of the electrode chip 450, which is situated on the other side of the axis CA, through the vicinity of the axis CA. The point Pa1 that is situated on a portion of the fused portion 455 on one side of the axis CA and that is farthest from the end face 453 and the point Pa2 that is situated on a portion of the fused portion 455 on the other side of the axis CA and that is farthest from the end face 453 are the same point on the axis CA. In contrast, in a form shown in FIG. 3, the fused portion 455 is not provided in the vicinity of the axis CA. As a result, the interfaces IS3 and IS4 between the fused portion 455 and the electrode base material 410 have curved surfaces that are more complicated than those in the form shown in FIG. 2. As regards the other points, the shape of the fused portion 455 shown in FIG. 3 is the same as the shape of the fused portion 455 shown in FIG. 2.

For example, compared with the forming of the fused portion 455 in the form shown in FIG. 2, the fused portion 455 in the form shown in FIG. 3 may be formed by a method in which an output of a laser beam is reduced, a method in which a laser beam applying position is set farther away from the end face 453 of the electrode chip 450 in an axial direction, a method in which a laser beam applying position is set farther away from the axis, or the like. Even in the form shown in FIG. 3, it is possible to satisfy the conditions of Formulas (1) to (5).

In the form shown in FIG. 3, the boundaries representing the interfaces IS3 and IS4 between the fused portion 455 and the electrode base material 410 are complicated curves. Therefore, even if cracks occur in the interfaces IS3 and IS4 between the fused portion 455 and the electrode base material 410, the cracks do not easily grow beyond a bend point along the interfaces IS3 and IS4.

The fused portion 455 and the electrode base material 410 are disposed so as to be engaged with each other. More specifically, with a portion of the electrode base material 410 fitted to a concave portion formed by the fused portion 455 and the end portion 454 of the electrode chip 450, the fused portion 455 and the electrode base material 410 are disposed. Therefore, even if cracks occur in the interfaces IS3 and IS4 between the fused portion 455 and the electrode base material 410, the fused portion 455 does not easily come off from the electrode base material 410.

Figure 4:
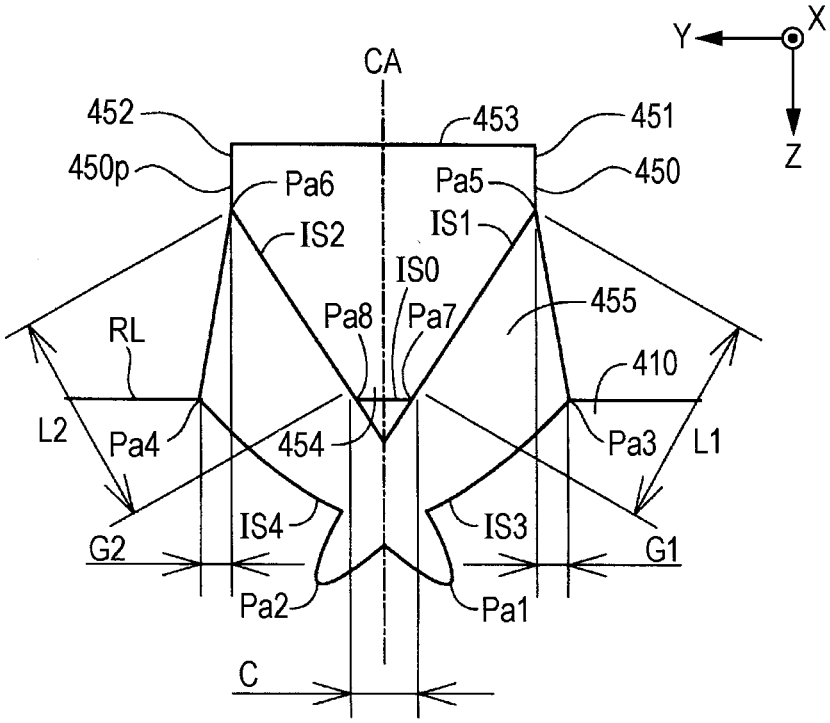
FIG. 4 is a cross-sectional view of another structure of the vicinity of the electrode chip 450 provided on the ground electrode 400 of the spark plug 10.

FIG. 4 is a cross-sectional view of another structure of the vicinity of the electrode chip 450 provided on the ground electrode 400 of the spark plug 10. In the form shown in FIG. 2, in the cross section RP, a portion of the fused portion 455 that is formed by using a laser beam applied to the outer surface 451 of the electrode chip 450 does not protrude beyond the axis CA to an opposite side. In addition, a portion of the fused portion 455 that is formed by using a laser beam applied to the outer surface 452 of the electrode chip 450 does not protrude beyond the axis CA to an opposite side. In contrast, in a form shown in FIG. 4, a portion of the fused portion 455 that is formed by using a laser beam applied to the outer surface 451 of the electrode chip 450 protrudes to the opposite side beyond the axis CA. In addition, a portion of the fused portion 455 that is formed by using a laser beam applied to the outer surface 452 of the electrode chip 450 protrudes to the opposite side beyond the axis CA. As a result, the interfaces IS3 and IS4 between the fused portion 455 and the electrode base material 410 have curved surfaces that are more complicated than those in the form shown in FIG. 2. As regards the other points, the shape of the fused portion 455 shown in FIG. 4 is the same as the shape of the fused portion 455 shown in FIG. 2.

For example, compared with the forming of the fused portion 455 in the form shown in FIG. 2, the fused portion 455 in the form shown in FIG. 4 may be formed by a method in which an output of a laser beam is increased or the like. Even in the form shown in FIG. 4, it is possible to satisfy the conditions of Formulas (1) to (5).

Even in the form shown in FIG. 4, the boundaries representing the interfaces IS3 and IS4 between the fused portion 455 and the electrode base material 410 are complicated curves that bend at sharp angles. Therefore, even if cracks occur in the interfaces IS3 and IS4 between the fused portion 455 and the electrode base material 410, the cracks do not easily grow beyond the bend point along the interfaces IS3 and IS4.

The fused portion 455 and the electrode base material 410 are disposed so as to be engaged with each other. In other words, with a convex portion of the electrode base material 410 fitted to a concave portion of the fused portion 455 and a convex portion of the fused portion 455 fitted to a concave portion of the electrode base material 410, the fused portion 455 and the electrode base material 410 are disposed. Therefore, even if cracks occur in the interfaces IS3 and IS4 between the fused portion 455 and the electrode base material 410, the fused portion 455 does not easily come off from the electrode base material 410.

Figure 5:
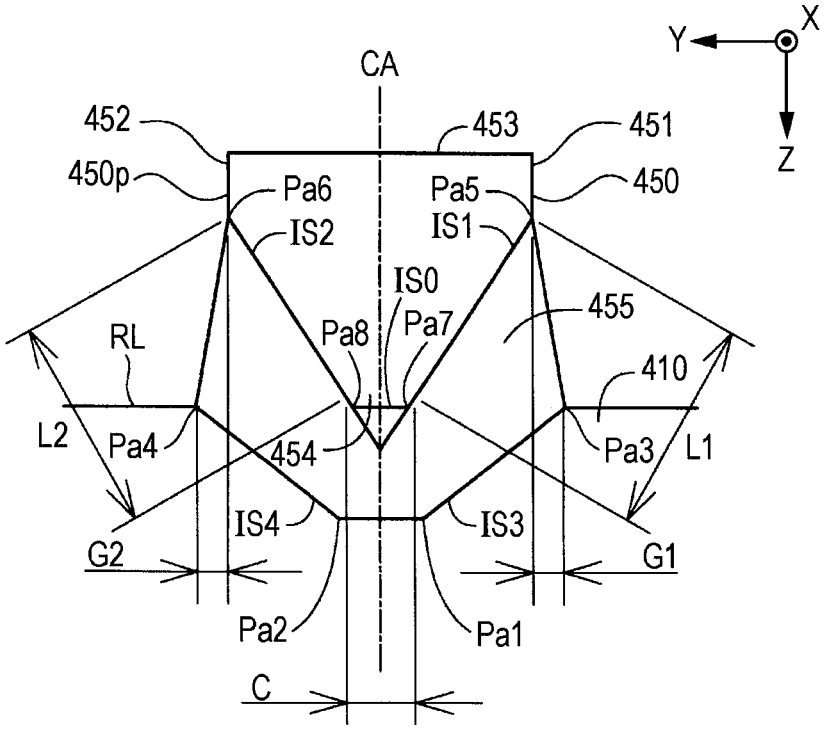
FIG. 5 is a cross-sectional view of another structure of the vicinity of the electrode chip 450 provided on the ground electrode 400 of the spark plug 10.

FIG. 5 is a cross-sectional view of another structure of the vicinity of the electrode chip 450 provided at the ground electrode 400 of the spark plug 10. In a form shown in FIG. 5, in the cross section RP, a portion of the fused portion 455 that is farthest from the end face 453 of the electrode chip 450 is substantially flat. Even in the form shown in FIG. 5, it is possible to satisfy the conditions of Formulas (1) to (5).

In the form shown in FIG. 5, the boundaries representing the interfaces IS3 and IS4 between the fused portion 455 and the electrode base material 410 include corners (see the vicinity of Pa1 and Pa2 in FIG. 5). Therefore, even if cracks occur in the interfaces IS3 and IS4 between the fused portion 455 and the electrode base material 410, the cracks do not easily grow beyond the corners along the interfaces IS3 and IS4.

The electrode chip 450 according to the embodiment corresponds to "chip" in the "Solution to Problem". The axis CA corresponds to "center axis". The cross section RP corresponds to "cross section that extends on and beyond the center axis of a cylinder". The interface IS0 corresponds to "chip-and-base-material interface".

The end point Pa7 corresponds to "end point on the chip-and-base-material interface on one side of the center axis". The end point Pa5 corresponds to "end point that is situated on the interface between the chip and the fused portion on one side of the center axis, and that is exposed to the outside". The point Pa3 corresponds to "end point that is situated on the interface between the electrode base material and the fused portion on one side of the center axis and that is exposed to the outside". The outer surface 451 corresponds to "outer surface of the cylindrical portion of the chip".

The end point Pa8 corresponds to "end point on the chip-and-base-material interface on the other side of the center axis". The end point Pa6 corresponds to "end point that is situated on the interface between the chip and the fused portion on the other side of the center axis, and that is exposed to the outside". The point Pa4 corresponds to "end point that is situated on the interface between the electrode base material and the fused portion on the other side of the center axis, and that is exposed to the outside". The outer surface 452 corresponds to "outer surface of the cylindrical portion of the chip".

B. Examples

B1. Relationship Between Wear Amount of Electrode Chip of Center Electrode and Size of Ground Electrode and Between Wear Amount of Electrode Chip of Ground Electrode and Size of Ground Electrode First, verifications were conducted regarding the effects of reducing the wear amount of an electrode chip of a center electrode and the wear amount of an electrode chip of a ground electrode by increasing the diameter of the cylindrical portion 450*p* of the electrode chip 450 of the ground electrode 400.

Figure 6:
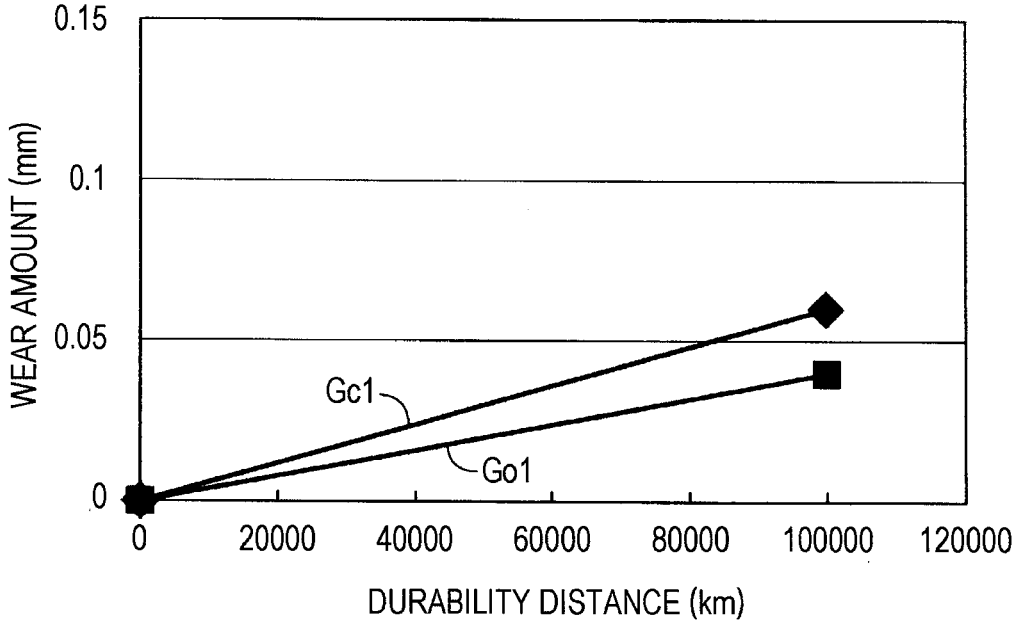
FIG. 6 is a graph showing the wear amount of an electrode chip of a center electrode and the wear amount of an electrode chip of a ground electrode when a spark plug in which the diameter of the electrode chip of the center electrode and the diameter of the electrode chip of the ground electrode are equal to each other is mounted on a naturally aspirated engine.

FIG. 6 is a graph showing the wear amount of an electrode chip of a center electrode and the wear amount of an electrode chip of a ground electrode when a spark plug in which the diameter of the electrode chip (not shown in FIG. 1) of the center electrode and a diameter A (see FIG. 2) of the electrode chip of the ground electrode are equal to each other is mounted on a naturally aspirated engine. The diameter of the electrode chip of the center electrode and the diameter A of the electrode chip of the ground electrode are each 0.7 mm. The discharge area of each is 0.38 $mm^2$.

The horizontal axis in FIG. 6 represents values obtained by converting the number of combustions in a combustion chamber of an engine on which each spark plug is mounted into the running distance of an automobile. The vertical axis represents the wear amount of the electrode chip of the center electrode and the wear amount of the electrode chip of the ground electrode. A graph Gc1 represents the wear amount of the electrode chip of the center electrode, and a graph Go1 represents the wear amount of the electrode chip of the ground electrode. FIG. 6 shows that, when a spark plug in which the diameter of the electrode chip of the ground electrode is equal to the diameter of the electrode chip of the center electrode is mounted on a naturally aspirated engine, the wear amount (Go1) of the electrode chip of the ground electrode is less than the wear amount (Gc1) of the electrode chip of the center electrode.

Figure 7:
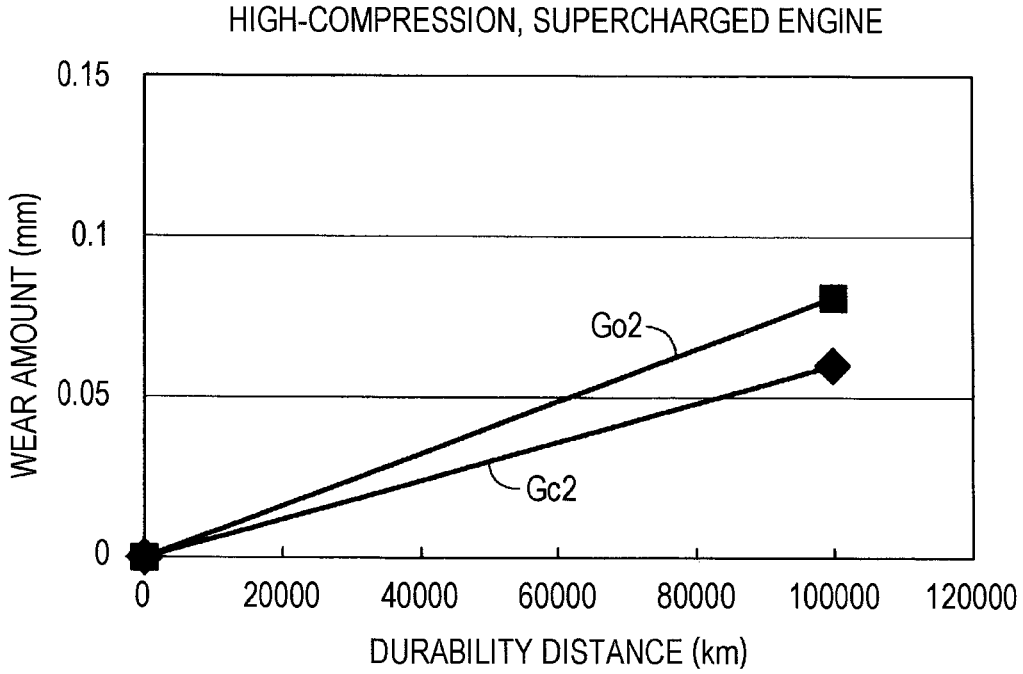
FIG. 7 is a graph showing the wear amounts of electrode chips when a spark plug whose specifications are the same as those used in a test illustrated in FIG. 6 is mounted on a supercharged engine.

FIG. 7 is a graph showing the wear amount of an electrode chip of a center electrode and the wear amount of an electrode chip of a ground electrode when a spark plug whose specifications are the same as those used in a test illustrated in FIG. 6 is mounted on a supercharged engine. The engine used in a test illustrated in FIG. 7 is an engine whose compression ratio is greater than that of the engine used in the test illustrated in FIG. 6, and where supercharging is performed. The other points of the engine used in the test illustrated in FIG. 7 are substantially the same as those of the engine used in the test illustrated in FIG. 6.

The horizontal axis in FIG. 7 also represents values obtained by converting the number of combustions in a combustion chamber of an engine on which each spark plug is mounted into the running distance of an automobile. The vertical axis represents the wear amount of the electrode chip of the center electrode and the wear amount of the electrode chip of the ground electrode. A graph Gc2 represents the wear amount of the electrode chip of the center electrode, and a graph Go2 represents the wear amount of the electrode chip of the ground electrode. It is understood that, with the same durability distance, the wear amount of the electrode chip of the ground electrode is larger when a spark plug in which the diameter of the electrode chip of the ground electrode is equal to the diameter of the electrode chip of the center electrode is mounted on a high-compression supercharged engine than when such a spark plug is mounted on a naturally aspirated engine having a low compression ratio (refer to Go1 in FIG. 6 and Go2 in FIG. 7). On the other hand, the wear amount of the electrode chip of the center electrode is not increased as much as the wear amount of the electrode chip of the ground electrode (refer to Gc1 in FIG. 6 and Gc2 in FIG. 7). As a result, the wear amount (Go2) of the electrode chip of the ground electrode is greater than the wear amount (Gc2) of the electrode chip of the center electrode.

Figures 8, 9, 10:
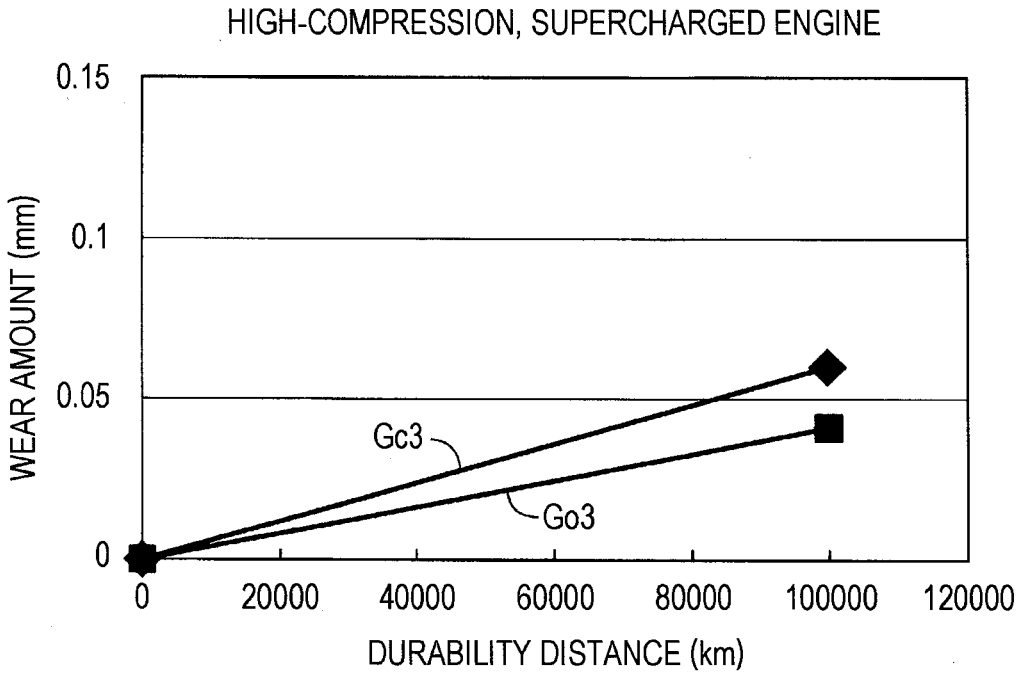
FIG. 8 is a graph showing the wear amount of an electrode chip of a center electrode and the wear amount of an electrode chip of a ground electrode when a spark plug in which the diameter of the electrode chip of the ground electrode is larger than the diameter of the electrode chip of the center electrode is mounted on the engine.
FIG. 9 is a graph of the results of ignitability evaluation tests for electrode chips 450 performed by using samples in which various values were set for diameters A of the electrode chips of ground electrodes.
FIG. 10 is a graph of the results of tests for evaluating the wearing rates of electrode chips 450 performed by using samples in which various values were set for diameters A of the electrode chips of ground electrodes.

FIG. 8 is a graph showing the wear amount of an electrode chip of a center electrode and the wear amount of an electrode chip of a ground electrode when a spark plug in which the diameter of the electrode chip of the ground electrode is larger than the diameter of the electrode chip of the center electrode is mounted on the engine used in the test shown in FIG. 7. In the spark plug used in a test illustrated in FIG. 8, the area of an end face of the electrode chip of the ground electrode is twice the area of an end face of the electrode chip of the center electrode. More specifically, the diameter A of the electrode chip of the ground electrode is 1.0 mm, and the discharge area thereof is 0.78 $mm^2$. The other points of the spark plug used in the test illustrated in FIG. 8 are, including the area of an end face of the electrode chip of the center electrode, the same as those of the spark plugs used in the tests illustrated in FIGS. 6 and 7.

The horizontal axis in FIG. 8 also represents values obtained by converting the number of combustions in a combustion chamber of an engine on which each spark plug is mounted into the running distance of an automobile. The vertical axis represents the wear amount of the electrode chip of the center electrode and the wear amount of the electrode chip of the ground electrode. A graph Gc3 represents the wear amount of the electrode chip of the center electrode, and a graph Go3 represents the wear amount of the electrode chip of the ground electrode. It is understood that the wear amount of the electrode chip of the ground electrode is smaller when a spark plug in which the diameter of the electrode chip of the ground electrode is larger than the diameter of the electrode chip of the center electrode is mounted on a high-compression supercharged engine than when a spark plug in which the diameter of the electrode chip of the ground electrode is equal to the diameter of the electrode chip of the center electrode is mounted on such an engine (refer to Go2 in FIG. 7 and Go3 in FIG. 8). As a result, it is understood that the wear amount of the electrode chip of the center electrode and the wear amount of the electrode chip of the ground electrode do not increase by a large amount from those when a naturally aspirated engine is used (see Gc1 and Got in FIG. 6 and Gc3 and Go3 in FIG. 8).

From the above-described results, when the spark plug is exposed to a high load, such as when the spark plug is used in a supercharged engine having a high compression ratio, it is understood that, if the diameter A (see FIG. 2) of the electrode chip of the ground electrode is increased, the durability distance, that is, the long life of the spark plug can be ensured.

B2. Ignitability Tests

Tests for evaluating the ignitability of electrode chips 450 were performed by using samples in which various values were set for the diameters A (see FIG. 2) of the electrode chips of ground electrodes with the diameters of electrode chips of center electrodes being a constant value of 0.7 mm. The ground electrode for each spark plug used in the test had the following structure.

Material of electrode base material: Inconel 600

Material of electrode chip: alloy containing platinum (Pt) as main component and 20% rhodium (Rh) by mass A: 0.7 to 1.5 mm G1, G2: 0.3 mm L1, L2: 0.8 mm H: 0.8 mm Each test was performed by mounting a spark plug, serving as a test sample, on one of the cylinders of a four-cylinder engine having a displacement of 1.5 L, and by mounting the same plug on the other cylinders in all of the tests.

For each test sample, the air/fuel ratio (A/F) was gradually increased to cause fuel to become lean, and the value at which misfiring occurred in 1% of the total number of flying sparks was defined as the misfiring limit for each test sample. For test samples whose misfiring limits were reduced by an amount greater than or equal to 2% with respect to the misfiring limit of the test sample in which A=1.0 mm, the ignitability was indicated by a cross (rated poor). For test samples whose misfiring limits were greater than the misfiring limit of the test sample in which A=1.0 mm, or whose misfiring limits were reduced by less than 2%, the ignitability was indicated by a circle (rated good). The test results are shown in FIG. 9.

FIG. 9 is a graph of the results of ignitability evaluation tests for the electrode chips 450 performed by using the samples in which various values were set for the diameters A of the electrode chips of the ground electrodes. The test results shown in FIG. 9 show that ignitability is good when the diameter A of the electrode chip of the ground electrode is from 0.7 to 1.2 mm.

B3. Durability Tests

Tests for evaluating the wearing rates of electrode chips 450 were performed by using samples formed by setting various values for the diameters A (see FIG. 2) of the electrode chips of ground electrodes. The other points of the spark plugs used in the tests are the same as those in the above-described ignitability tests.

Each test was performed by mounting a spark plug, serving as a test sample, on one of the cylinders of a four-cylinder engine having a displacement of 1.5 L, and by mounting the same plug on the other cylinders in all of the tests. The tests were performed by an operation in a full throttle state (engine speed: 5000 rpm) for a certain time.

For each test sample, the difference between the position of a point in an axial direction that is closest to the center electrode 100 in the axial direction before the test and that after the test was measured as the wear amount. For test samples whose wear amounts were greater than or equal to 5% with respect to the wear amount of the test sample in which A=1.0 mm, the durability was indicated by a cross (rated poor). For test samples whose wear amounts were less than the wear amount of the test sample in which A=1.0 mm or whose wear amounts were increased by less than 5%, the durability was indicated by a circle (rated good). The test results are shown in FIG. 10.

FIG. 10 is a graph of the results of the tests for evaluating the wearing rates of the electrode chips 450 by using the samples in which various values were set for the diameters A of the electrode chips of the ground electrodes. The test results shown in FIG. 10 show that durability is good when the diameter A of the electrode chip of the ground electrode is from 0.8 to 1.5 mm.

Considering the results of the ignitability tests illustrated in FIG. 9 and the results of the durability tests illustrated in FIG. 10, it is desirable that the diameter A of an electrode chip of a ground electrode be from 0.8 to 1.2 mm.

B4. Peeling Performance Tests 1

Tests for evaluating peeling performances of electrode chips 450 were performed by using samples formed by setting various values of from 0.1 to 0.4 mm for a width C of an interface between an electrode chip of a ground electrode and an electrode base material and by setting various values of from 0.1 to 0.8 mm for lengths L1 and L2 of an interface between the electrode chip and a fused portion. In performing the tests, spark plugs in which the diameter A (see FIG. 2) of the electrode chip of the ground electrode was 0.7 mm and spark plugs in which the diameter A (see FIG. 2) of the electrode chip of the ground electrode was 1.0 mm were prepared. In the spark plugs used in the tests, L1=L2. The other points of the spark plugs used in the tests are the same as those in the above-described ignitability tests.

The lengths L1 and L2 of the interface between the electrode chip and the fused portion were changed by changing the laser beam applying position during laser beam welding and by changing the distance between the laser beam applying position and the axis CA. In test samples used in the present tests, the value of L1 and the value of L2 are equal to each other. When L1 and L2 are to be collectively indicated, they are hereunder indicated by "L".

Each test was performed by mounting a spark plug, serving as a test sample, on one of the cylinders of a four-cylinder engine having a displacement of 1.5 L, and by mounting the same plug on the other cylinders in all of the tests. The tests were performed by repeating for 100 hours a process of performing an operation in a full throttle state (engine speed: 5000 rpm) for one minute and then of stopping the operation for one minute.

Figure 11:
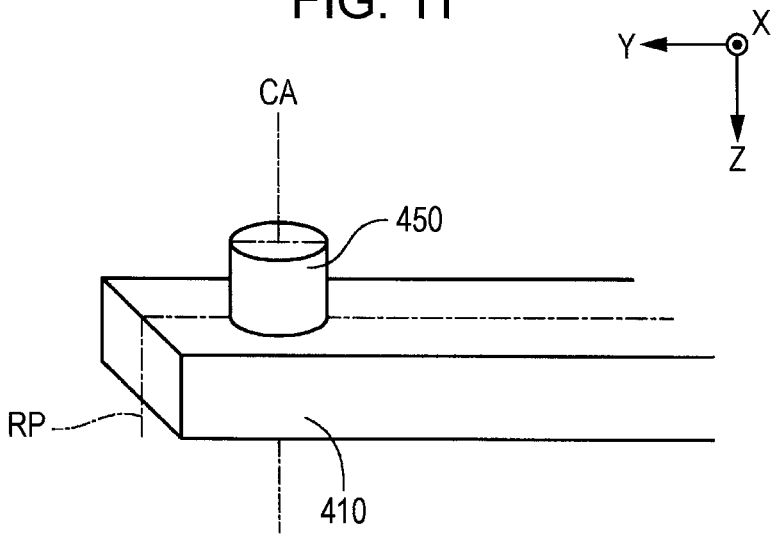
FIG. 11 illustrates a cross section RP serving as a reference when a peeling performance test evaluation was performed.
Figure 12:
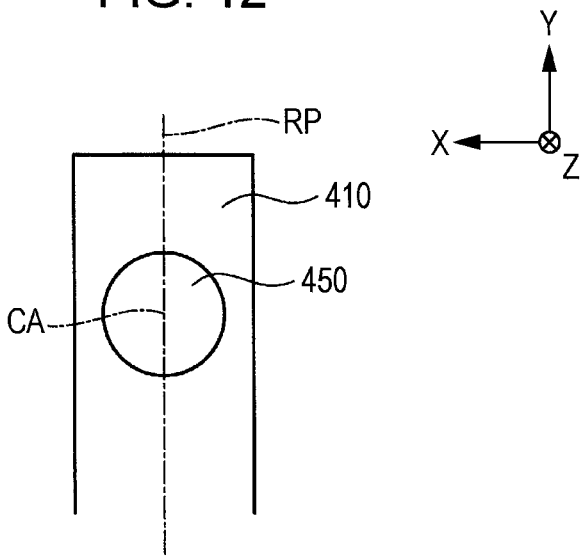
FIG. 12 illustrates the cross section RP serving as a reference when the peeling performance test evaluation was performed.

FIGS. 11 and 12 each illustrate a cross section RP serving as a reference when the evaluations of the peeling performance test were performed. In FIGS. 11 and 12, for the sake of easier understanding of the technology, the electrode chip 450 and the electrode base material 410 are shown in a state prior to forming the fused portion 455. The evaluations of the peeling performance tests were performed by measuring the sizes of cracks in the interfaces IS1 and IS2 between the electrode chip and the fused portion in the cross section RP that extends on and beyond the axis CA of the spark plug and that includes a direction in which the ground electrode 400 extends towards the axis CA. More specifically, anti-peeling performances were evaluated on the basis of a ratio Ra (%) of the total length of the cracks with respect to the total length of the interface IS1 and the interface IS2 between the electrode chip and the fused portion in directions perpendicular to the axis CA (the Y axis directions in FIG. 2 and FIGS. 11 and 12) when photographs were taken in an axial direction. In the embodiment, the cross section RP corresponds to a surface that does not include a portion WPL (see FIG. 2) fused by a laser beam applied last during laser beam welding.

Figure 13:
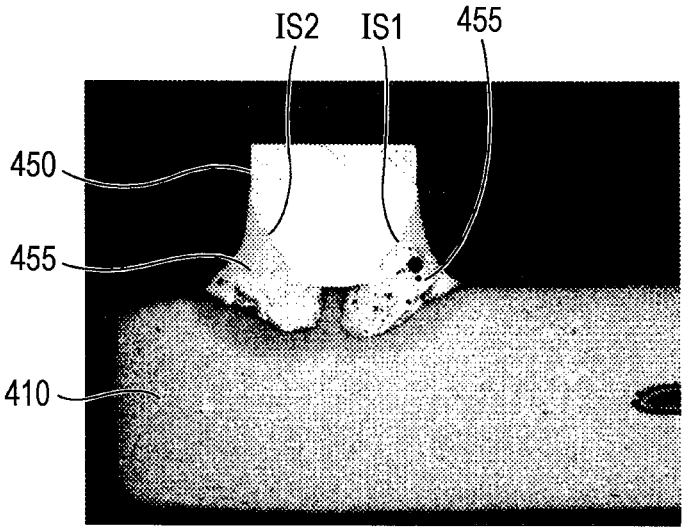
FIG. 13 is a cross-sectional view, at a cross section RP, of one test sample prior to starting an anti-peeling performance test.
Figure 14:
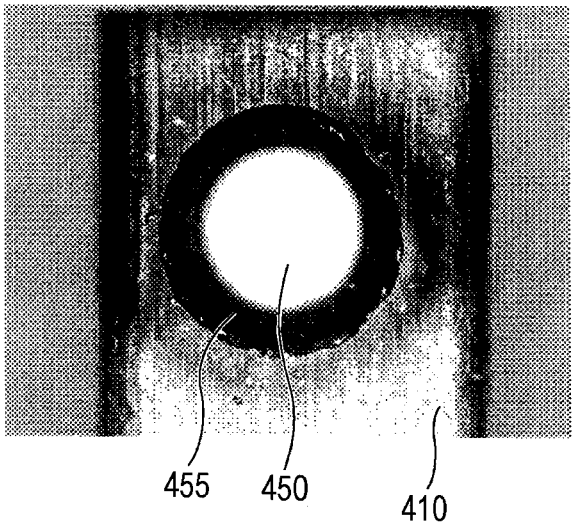
FIG. 14 is a plan view of the one test sample prior to starting the anti-peeling performance test.

FIG. 13 is a cross-sectional view, at a cross section RP, of one test sample prior to starting the anti-peeling performance test. FIG. 14 is a plan view of the one test sample prior to starting the anti-peeling performance test. In the test sample prior to starting the anti-peeling performance test, no cracks are formed in the interfaces IS1 and IS2 between the electrode chip 450 and the fused portion 455.

Figure 15:
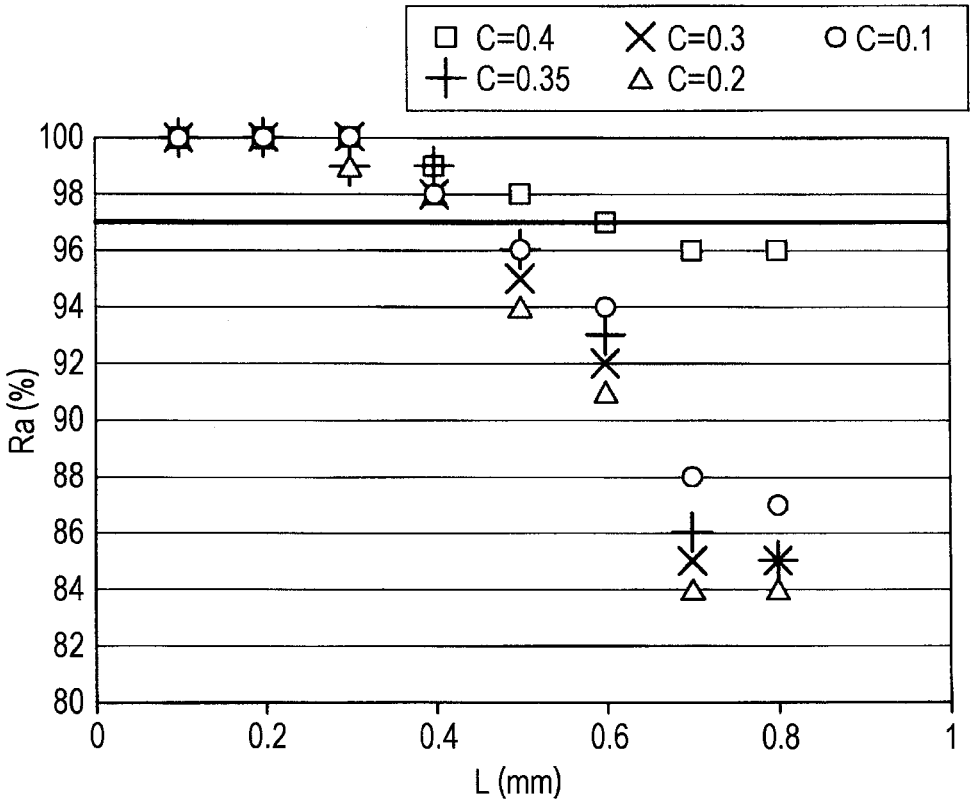
FIG. 15 is a graph of the results of anti-peeling performance tests performed by using spark plugs in which a diameter A of an electrode chip of a ground electrode was 1.0 mm.

FIG. 15 is a graph of the results of the anti-peeling performance tests performed by using spark plugs in which the diameter A of the electrode chip of the ground electrode was 1.0 mm. The horizontal axis represents the length L of the interface between the electrode chip and the fused portion. The vertical axis represents the ratio Ra of the total length of the cracks photographed in an axial direction with respect to the diameter A of the electrode chip 450. If Ra is less than or equal to 97%, the probability with which the electrode chip 450 comes off from the fused portion 455 is low. In FIG. 15, the position where Ra=97% is indicated by a solid line.

FIG. 15 shows that, in spark plugs in which the diameter A of the electrode chip is 1.0 mm, RA<97% is achieved regardless of the size C of the interface IS0 in a range of L≥0.7 mm. From this, it is understood that, if the ratio of the length L of the interface between the electrode chip and the fused portion with respect to the diameter A of the electrode chip 450 is greater than or equal to 0.7, the anti-peeling performance is good.

In the graph shown in FIG. 15, in the test samples in which C≤0.35 mm or less, if L≥0.7 mm, Ra≤88% is achieved. In contrast, in the test sample in which C=0.4 mm, even if L≥0.7 mm, Ra=96%. From this, it is understood that, if the ratio of the length L of the interface between the electrode chip and the fused portion with respect to the diameter A of the electrode chip 450 is greater than or equal to 0.7, and the distance between the end points Pa7 and Pa8 on the two ends of the interface IS0 is less than or equal to 0.35 mm, the anti-peeling performance is even better.

Figure 16:
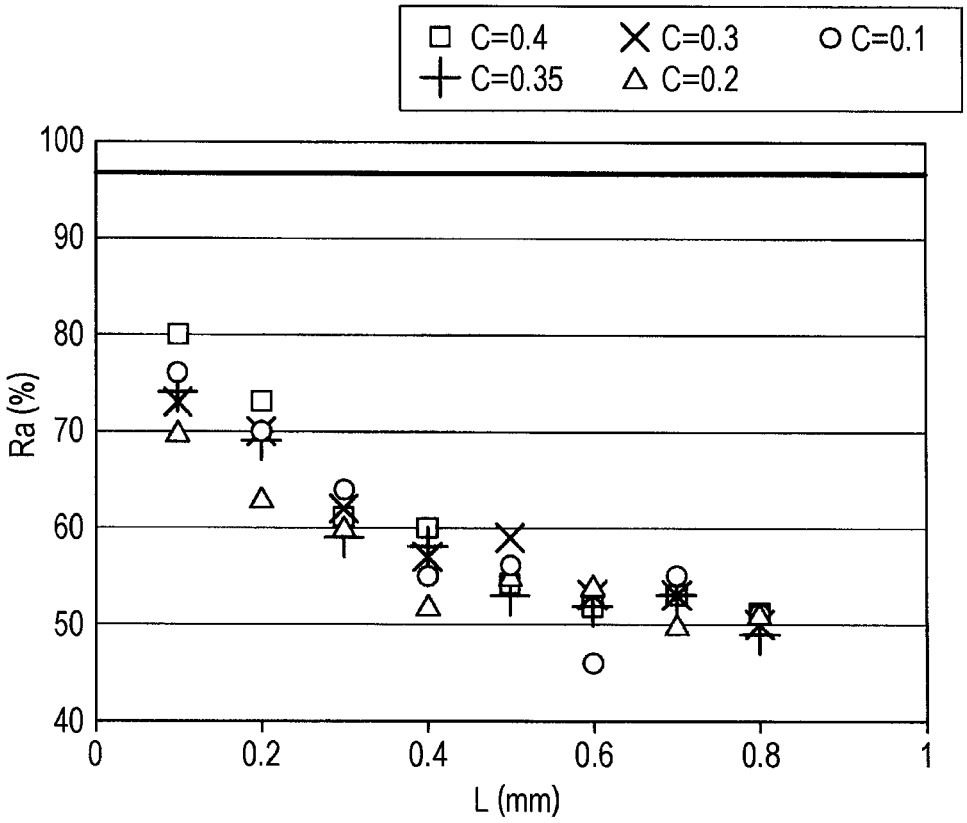
FIG. 16 is a graph of the results of anti-peeling performance tests performed by using spark plugs in which a diameter A of an electrode chip of a ground electrode was 0.7 mm.

FIG. 16 is a graph of the results of the anti-peeling performance tests performed by using the spark plugs in which the diameter A of the electrode chip of the ground electrode was 0.7 mm. The horizontal axis represents the length L of the interface between the electrode chip and the fused portion. The vertical axis represents the ratio Ra of the total length of the cracks photographed in an axial direction with respect to the diameter A of the electrode chip 450. As in FIG. 15, in FIG. 16, the position where Ra=97% is indicated by a solid line.

FIG. 16 shows that, in the spark plugs in which the diameter A of the electrode chip is 0.7 mm, RA<97% is achieved regardless of the size C of the interface IS0 between the electrode chip and the fused portion. This is thought to be because, in the spark plugs in which the diameter A of the electrode chip is 0.7 mm, since the diameter of the electrode chip 450 is sufficiently small, the interface IS0 (see FIGS. 2 to 5) between the electrode chip 450 and the electrode base material 410 corresponding to a remaining fused portion is not formed, as a result of which cracks are not easily formed.

B5. Peeling Performance Tests 2

Tests for evaluating the peeling performances of electrode chips 450 were performed by using samples formed by setting various values of from 0.1 to 0.4 mm for distances G1 and G2 between outer surfaces of an electrode chip of a ground electrode and ends of a fused portion 455 and by setting various values of from 0.1 to 0.8 mm for the lengths L1 and L2 of an interface between the electrode chip and the fused portion. In performing the tests, spark plugs in which the diameter A (see FIG. 2) of the electrode chip of the ground electrode was 0.7 mm and spark plugs in which the diameter A (see FIG. 2) of the electrode chip of the ground electrode was 1.0 mm were prepared. In the spark plugs used in the tests, G1=G2. The other points of the spark plugs used in the tests are the same as those in the above-described peeling performance tests 1. The operating method and the specifications of an engine used in the durability tests are also the same as those in the above-described peeling performance tests 1.

The distance G1 between the outer surface of the electrode chip of the ground electrode and an end of the fused portion 455 and the distance G2 between the outer surface of the electrode chip of the ground electrode and the other end of the fused portion 455 were changed by changing the diameter of a laser beam used during laser beam welding. In test samples used in the present tests, the value of G1 and the value of G2 are equal to each other. When G1 and G2 are to be collectively indicated, they are hereunder indicated by "G".

Figure 17:
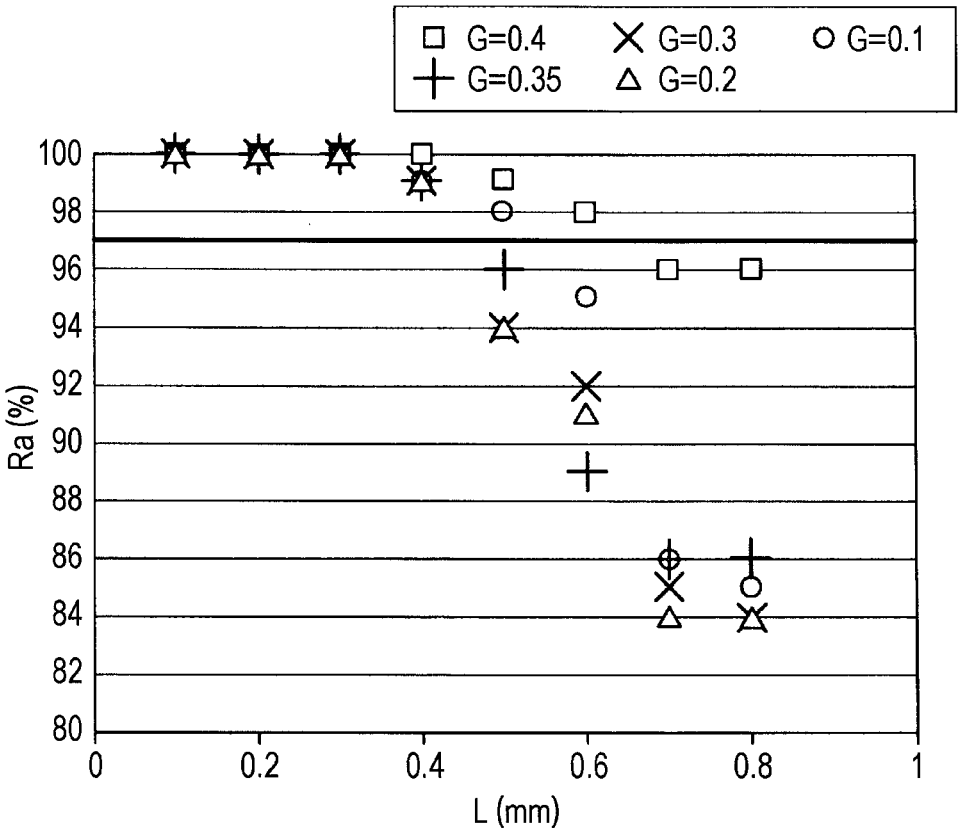
FIG. 17 is a graph of the results of anti-peeling performance tests performed by using spark plugs in which a diameter A of an electrode chip of a ground electrode was 1.0 mm.

FIG. 17 is a graph of the results of the anti-peeling performance tests performed by using the spark plugs in which the diameter A of the electrode chip of the ground electrode was 1.0 mm. The horizontal axis represents the length L of the interface between the electrode chip and the fused portion. The vertical axis represents the ratio Ra of the total length of cracks photographed in an axial direction with respect to the diameter A of the electrode chip 450. Even in FIG. 17, the position where Ra=97% is indicated by a solid line.

FIG. 17 shows that, in the spark plugs in which the diameter A of the electrode chip is 1.0 mm, RA<97% is achieved regardless of the distance G between the outer surface of the electrode chip and an end of the fused portion in a range of L≥0.7 mm. From this, it is understood that, if the ratio of the length L of an interface between the electrode chip and the fused portion with respect to the diameter A of the electrode chip 450 is greater than or equal to 0.7, the anti-peeling performance is good.

In the graph shown in FIG. 17, in the test samples in which G≤0.35 mm or less, if L≥0.7 mm, Ra≤86% is achieved. In contrast, in the test sample in which C=0.4 mm, even if L≥0.7 mm, Ra=96%. From this, it is understood that, if the ratio of the length L of the interface between the electrode chip and the fused portion with respect to the diameter A of the electrode chip 450 is greater than or equal to 0.7, and the distance between the outer surface 451 of the electrode chip and the end point Pa3 on the fused portion and the distance between the outer surface 452 of the electrode chip and the end point Pa4 on the fused portion is less than or equal to 0.35 mm, the anti-peeling performance is even better.

Figure 18:
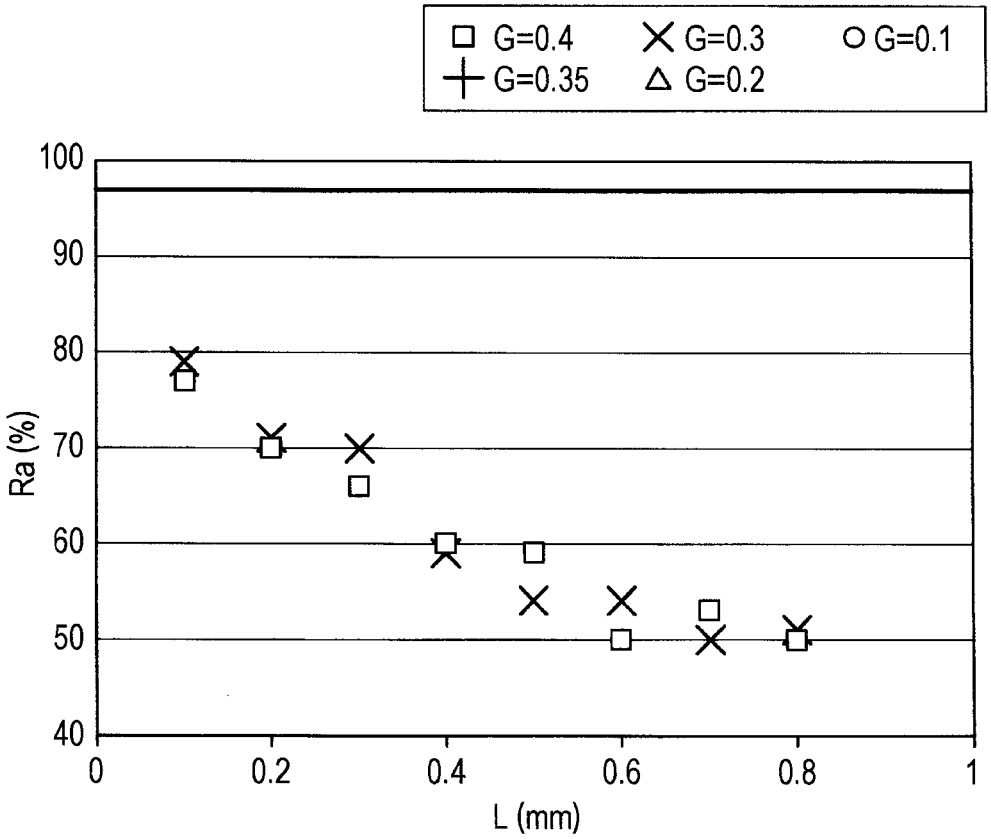
FIG. 18 is a graph of the results of anti-peeling performance tests performed by using spark plugs in which a diameter A of an electrode chip of a ground electrode was 0.7 mm.

FIG. 18 is a graph of the results of the anti-peeling performance tests performed by using the spark plugs in which the diameter A of the electrode chip of the ground electrode was 0.7 mm. The horizontal axis represents the length L of the interface between the electrode chip and the fused portion. The vertical axis represents the ratio Ra of the total length of cracks photographed in an axial direction with respect to the diameter A of the electrode chip 450. Even in FIG. 18, the position where Ra=97% is indicated by a solid line.

FIG. 18 shows that, in the spark plug in which the diameter A of the electrode chips is 0.7 mm, RA<97% is achieved regardless of the length L of the interface between the electrode chip and the fused portion and the distance G between the outer surface of the electrode chip and an end of the fused portion. This is thought to be because, in the spark plugs in which the diameter A of the electrode chip is 0.7 mm, since the diameter of the electrode chip 450 is sufficiently small, the interface IS0 between the electrode chip 450 and the electrode base material 410 corresponding to a remaining fused portion is not formed, as a result of which cracks are not easily formed.

C. Modifications

C1. First Modification

In the embodiments shown in FIGS. 2 to 5, since, in the above-described embodiments, a surface of the electrode base material 410 is a flat surface, the reference line RL defined by the points Pa3 and Pa4 coincides with a surface of the electrode base material 410 in the cross section RP. However, the surface of the electrode base material 410 need not be a flat surface.

C2. Second Modification

In each of the above-described examples, a test was performed on a plug in which the diameter A of the electrode chip was 1.0 mm. However, even if the diameter A of the electrode chip is set so as to have other values, as long as the aforementioned Formulas (1) and (2) are satisfied, the lengths of the interfaces IS1 and IS2 can be made longer than those in the form in which the aforementioned Formulas (1) and (2) are not satisfied. Therefore, it is possible to increase the period up to when the electrode chip 450 comes off from the fused portion 455 due to cracks that occur in the interfaces IS1 and IS2. However, it is desirable that the diameter A of the electrode chip be from 0.8 to 1.2 mm (see FIGS. 9 and 10).

C3. Third Modification

In each of the above-described embodiments, the electrode chip 450 is formed of an alloy containing platinum (Pt) as a main component and 20% rhodium (Rh) by mass.

However, the electrode chip may be composed of Pt, Rh, Ir, Ru, etc., or any other element such as W or Re.

The present invention is not limited to the above-described embodiments, examples, and modifications. The present invention may be realized by using various structures within a scope that does not depart from the gist of the present invention. For example, any of the technical features in the embodiments, examples, and modifications corresponding to the technical features in the forms described in the "Summary of Invention" section, may be replaced with another or may be combined with another as appropriate for solving some or all of the aforementioned problems or for achieving some or all of the aforementioned advantages. If technical features thereof are not described as being essential, they may be omitted as appropriate.

REFERENCE SIGNS LIST

10: spark plug
90: internal combustion engine
100: center electrode
190: terminal metal shell
200: insulator
290: shaft hole
300: metal shell
310: end face
400: ground electrode
410: electrode base material
450: electrode chip
450*p*: cylindrical portion
451, 452: outer surface of electrode chip
453: end face of electrode chip
454: end portion of electrode chip
455: fused portion
910: inner wall
920: combustion chamber
CA: axis
G1: distance between outer surface 451 of electrode chip 450 and end point Pa3
G2: distance between outer surface 452 of electrode chip 450 and end point Pa4
L1: distance between end point Pa7 on interface IS0 and end point Pa5 on interface IS1
L2: distance between end point Pa8 on interface IS0 and end point Pa6 on interface IS2
SG: gap (spark gap)
RL: reference line
RP: cross section
IS0: interface between electrode chip 450 and electrode base material 410
IS1: interface between electrode chip 450 and fused portion 455
IS2: interface between electrode chip 450 and fused portion 455
IS3: interface between electrode base material 410 and fused portion 455
IS4: interface between electrode base material 410 and fused portion 455
Pa1: point situated on a portion of fused portion 455 on one side of axis CA and farthest from end face 453
Pa2: point situated on a portion of fused portion 455 on the other side of axis CA and farthest from end face 453
Pa3: end point on interface IS3 that is situated on one side of axis CA and that is exposed to outside
Pa4: end point on interface IS4 that is situated on the other side of axis CA and that is exposed to outside
Pa5: end point on interface IS1 that is situated on one side of axis CA and that is exposed to outside
Pa6: end point on interface IS2 that is situated on the other side of axis CA and that is exposed to outside
Pa7: end point situated on interface IS0 and situated on one side of axis CA
Pa8: end point situated on interface IS0 and situated on the other side of axis CA
WPL: portion welded last when welding electrode chip and electrode base material

The invention claimed is:

1. A spark plug comprising:
a ground electrode including;
a chip whose one end has a shape of a cylinder having a diameter from 0.8 to 1.2 mm and whose main component is a noble metal, and
an electrode base material, to which a portion of the other end of the chip is joined through a fused portion where the chip and the electrode base material are fused; and
a chip-and-base-material interface in which a surface of the other end of the chip and the electrode base material contact each other and which is surrounded by the fused portion,
wherein, in a cross section passing through a center axis of the cylinder, a distance between an end point that is located on one side of the chip-and-base-material interface with respect to the center axis and an end point that is located on an interface between the chip and the fused portion that is exposed to the outside, is equal to or greater than 0.7 times the diameter, and
the chip-and-base-material interface has a surface where an unmelted portion of the chip and an unmelted portion of the electrode base material abut each other.

2. The spark plug according to claim 1, wherein, in the cross section, a distance between two end points on the chip-and-base-material interface is equal to or less than 0.35 mm.

3. The spark plug according to claim 1, wherein, in the cross section, a distance in a direction orthogonal to the center axis between an end point that is located on an interface between the electrode base material and the fused portion and is exposed to the outside and an outer surface of the cylindrical portion of the chip is equal to or less than 0.35 mm.

4. The spark plug according to claim 1, wherein the noble metal is selected from the group consisting of Pt, Rh, Ir, and Ru.

5. The spark plug according to claim 2, wherein, in the cross section, a distance in a direction orthogonal to the center axis between an end point that is located on an interface between the electrode base material and the fused portion and is exposed to the outside and an outer surface of the cylindrical portion of the chip is equal to or less than 0.35 mm.

6. The spark plug according to claim 2, wherein the noble metal is selected from the group consisting of Pt, Rh, Ir, and Ru.

7. The spark plug according to claim 3, wherein the noble metal is selected from the group consisting of Pt, Rh, Ir, and Ru.

8. The spark plug according to claim 5, wherein the noble metal is selected from the group consisting of Pt, Rh, Ir, and Ru.

9. The spark plug according to claim 1, wherein at the chip-and-base-material interface, the other end of the chip directly contacts the electrode base material.

10. The spark plug according to claim 1, wherein an outline between the two end points is substantially linear.

11. The spark plug according to claim 1, wherein the fused portion is not provided in a vicinity of the center axis of the cylinder.

12. The spark plug according to claim 1, wherein a portion of the fused portion that is formed by using a laser beam applied to the outer surface of the chip protrudes to an opposite side beyond the center axis.

13. The spark plug according to claim 1, wherein a portion of the fused portion that is farthest from the one end of the chip is substantially flat.

* * * * *